United States Patent [19]

Pickering et al.

[11] 4,246,512

[45] Jan. 20, 1981

[54] CO-AXIAL MULTI CAVITY ANODE MAGNETRONS

[75] Inventors: Alan H. Pickering; Geoffrey J. Rowlands; David R. Tice, all of Chelmsford, England

[73] Assignee: English Electric Valve Company Limited, Chelmsford, England

[21] Appl. No.: 33,241

[22] Filed: Apr. 25, 1979

[30] Foreign Application Priority Data

Apr. 25, 1978 [GB] United Kingdom ..... 16172/78

[51] Int. Cl.[3] ..... H01J 25/50

[52] U.S. Cl. ..... 315/39.77; 315/39.51; 315/39.71; 315/39.75

[58] Field of Search ..... 315/39.51, 39.53, 39.71, 315/39.75, 39.77

[56] References Cited

U.S. PATENT DOCUMENTS

| | | | |
|---|---|---|---|
| 2,854,603 | 9/1958 | Collier et al. | 315/39.77 |
| 3,169,211 | 2/1965 | Drexler et al. | 315/39.51 X |
| 3,383,551 | 5/1968 | Gerard | 315/39.77 |
| 3,471,744 | 10/1969 | Pryor | 315/39.77 |
| 3,706,910 | 12/1972 | Foreman | 315/39.77 |
| 4,053,850 | 10/1977 | Farney et al. | 316/39.53 |
| 4,074,169 | 2/1978 | Harada | 315/39.77 |

*Primary Examiner*—Saxfield Chatmon, Jr.
*Attorney, Agent, or Firm*—Diller, Ramik & Wight

[57] ABSTRACT

In a co-axial multi cavity anode magnetron spurious resonances which would otherwise occur in the space between a magnetic pole piece and an anode shell are suppressed. The resonances may be suppressed by means of short circuit pins located within the anode shell.

16 Claims, 3 Drawing Figures

CO-AXIAL MULTI CAVITY ANODE MAGNETRONS

Figure 1:
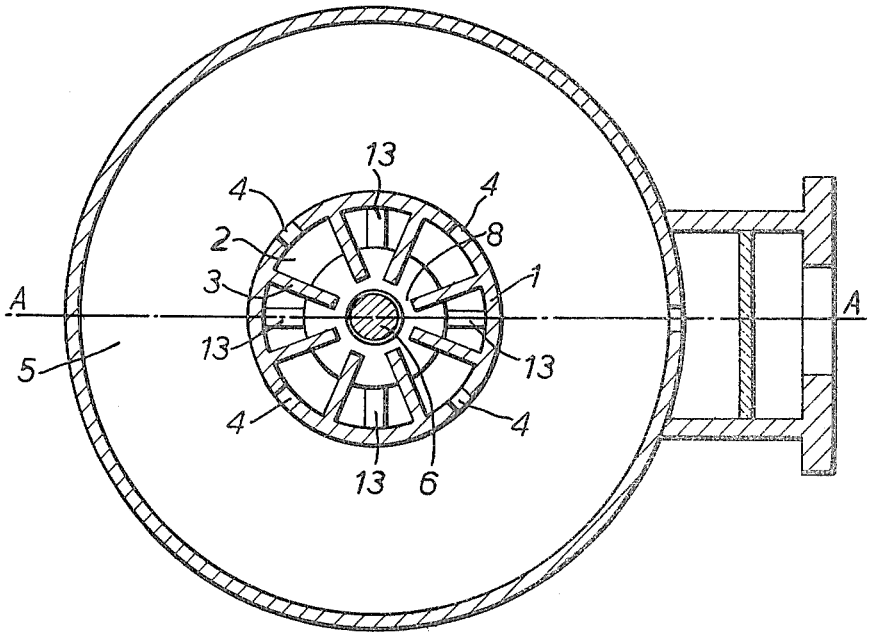

This invention relates to co-axial multi cavity anode magnetrons.

Typically a co-axial multi cavity anode magnetron consists of an anode shell within which are cavities formed by radial vanes. Axial slots are provided to extend through the anode shell in between alternate pairs of vanes. Outside the anode shell is a co-axial resonator provided to be excited in the circular electric TEO1 mode. The anode shell co-axially surrounds a cathode. Within and at each end of the anode shell is a co-axial cylindrical magnetic pole piece which together act to produce a magnetic field in the cylindrical interaction space bounded by the co-axial cathode and the tips of the radical vanes. In order to attenuate resonances of the anode structure other than those of the circular electric TEO1 mode, two attenuators are commonly provided. The first is a cavity attenuator in the form of a lossy annulus behind one or both of the end plates of the outer co-axial resonator. The second is a slot attentuator in the form of a lossy cylinder in the annular space between a pole piece and the anode shell, the lossy cylinder overlapping the ends of the axial slots in the anode shell to attenuate the so called "slot modes".

A typical co-axial multi cavity anode magnetron as described above tends to suffer from the problem of anomalous power dissipation in the aforementioned slot attenuator in the intended mode of oscillation.

One object of the present invention is to provide an improved co-axial multi cavity anode magnetron in which the aforementioned anomalous power dissipation is reduced.

According to this invention a co-axial multi cavity anode magnetron is provided, which includes a slot attenuator provided in the space between a magnetic pole piece and the anode shell of the magnetron, said slot attenuator overlapping the ends of axial slots provided in said anode shell to communicate with a main resonator co-axially surrounding said anode shell and wherein means are provided for suppressing spurious resonances occurring in the space between a magnetic pole piece and said anode shell.

Said suppressing means may be means for creating one or more short circuits between radially spaced points on a magnetic pole piece and said anode shell.

In one embodiment of the invention short circuiting metallic pins are provided to extend between radially spaced points on a magnetic pole piece and said anode shell lying between adjacent slots in said anode shell.

Where said slot attenuator lies in the space between one of two magnetic pole pieces and said anode shell, preferably said short circuiting means is provided to create short circuits between radial points on both magnetic pole pieces and the anode shell.

Where said short circuiting means comprises metallic pins, preferably one pin is provided to extend between a point mid way between each pair of adjacent slots in the anode shell and a radially opposite point on a magnetic pole piece.

In another embodiment of the present invention, the outer surface of said slot attenuator is provided with a metallic skin in regions other than in strips, radially opposite the slots in said anode shell. In the simplest case, where the slot attenuator is a lossy cylinder, said metallic skin may be provided only on the internal cylindrical surface of said slot attenuator.

Preferably, however, said metallic skin is provided over the entire surface of said slot attenuator except in regions radially opposite said slits in said anode shell.

In one embodiment of the invention said metallic skin is provided on said slot attenuator by the evaporation of metal in vacuum, regions which are not required to be metallised having been protected by masking or shields. However, the metallic skin may be provided on said slot attenuator in any of a number of other ways, for example, by forming said metallic skin from thin metal sheet which is pressed to shape, or by metallic paint applied to the surface of said slot attenuator or by sintering and electro plating the surface of said slot attenuator or by sputtering.

Figure 2:
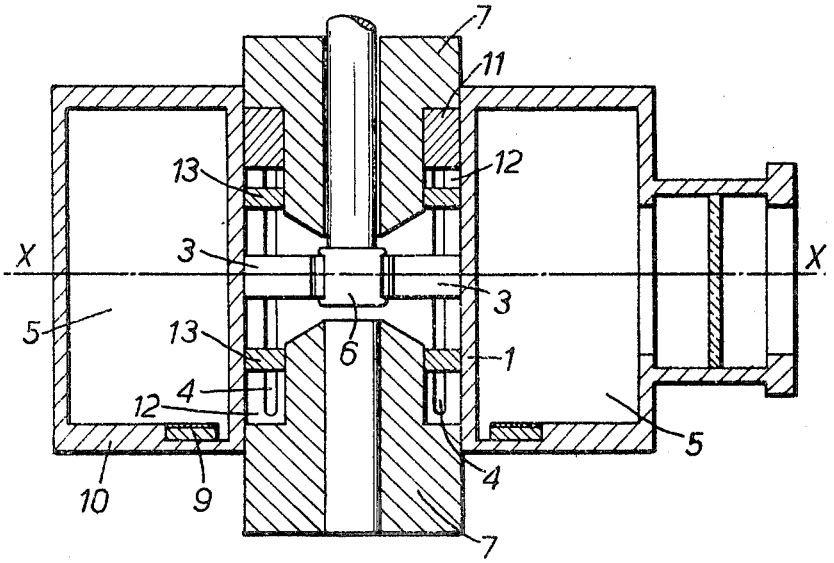
Figure 3:
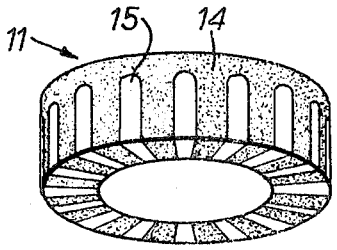

The invention is illustrated in and further described with reference to the accompanying drawings in which, FIG. 1 is a section in plan of one example of co-axial multi cavity anode magnetron in accordance with the present invention, FIG. 2 is a section in elevation along the line A—A of FIG. 1 and FIG. 3 illustrates a modification.

Referring to FIGS. 1 and 2, the co-axial multi cavity anode magnetron comprises an anode shell 1, within which are cavities such as 2 formed by radial vanes such as 3. Between each alternate pair of vanes 3 are slots 4, which extend through the anode shell 1.

Outside of the anode shell 1 is a co-axial resonator 5, which is provided to be excited in the circular electric TEO1 mode.

The anode shell 1 co-axially surrounds a co-axial cathode 6.

With the anode shell 1, and at each end thereof, is a co-axial cylindrical magnetic pole piece 7. The pole pieces 7 are provided to produce a magnetic field in the cylindrical interaction space 8 bounded by the outer surface of the co-axial cathode 6 and the tips of the radial vanes 3.

A cavity attenuator in the form of a lossy annulus 9 is provided behind the end plate 10 of the co-axial resonator 5, the purpose of which is, as known per se, to attenuate resonances other than those in the circular electric TEO1 mode. For the same purposes, a slot attenuator in the form of a lossy cylinder 11 is positioned in the annular space between one of the pole pieces 7 (the upper one as viewed) and the anode shell 1. As shown the lossy cylinder forming the slot attenuator 11 overlaps the slots 4 at one end.

As so far described the co-axial magnetron is as known per se and with this magnetron, there would be a tendency for it to suffer from the problem of anomalous power dissipation in the slot attenuator 11. In the intended mode of oscillation, it has been found that one source of such anomalous power dissipation is resonance in the co-axial space 12 between each pole piece 7 and the anode shell 1 with zero, one, two or possible larger numbers of periodicities around the circumference. The frequencies of such spurious resonances also depend upon the dimensions of the slot attenuator 11.

In order to reduce such spurious resonances and thus the anomalous power dissipation in the slot attenuator 11 caused thereby, means are provided for creating one or more short circuits between radially spaced points on a pole piece 7 and the anode shell 1. In this present example, the short circuiting means consists of a plurality of metallic pins 13 extending between points on the pole pieces 7 and the anode shell 1 mid way between adjacent slots 4 in the anode shell 1. Assuming there are N/2 anode vanes and N/2 slots, the number of pins 13 provided will normally be N/2. In this present example, therefore, four pins 13 are provided.

The width (i.e. the dimension in a circumferential direction) of each pin 13 compared to the peripheral distance between adjacent slots is provided to be sufficiently small as to reduce any tendency for interference with the normal operation of the intended mode of oscillation to occur.

Referring to FIG. 3, this illustrates a slot attenuator utilised in a modification. The metallic pins 13 of FIGS. 1 and 2 are dispensed with and instead the slot attenuator 11 has applied to it a close fitting metal skin 14 extending over its entire surface except for strips 15 extending over the face of the attenuator and along the outside cylindrical wall of the attenuator over those portions which are adjacent the slots 4 in the anode shell 1 of FIGS. 1 and 2. Whilst care must be taken correctly to orientate the attenuator 11 relative to the slots 4 when utilising an attenuator as illustrated in FIG. 3, nevertheless the overall assembly has been found to be simpler than with the use of metallic pins such as 13 as illustrated in FIGS. 1 and 2.

In the example illustrated in FIG. 3, the metallic skin is formed by evaporation in vacuum with, the strips 15 being protected by shields or masking.

We claim:

1. A co-axial multi-cavity magnetron which comprises a cathode, an anode shell co-axially surrounding said cathode and including a plurality of radial vanes extending toward said cathode but terminating in spaced relation thereto, a main resonator co-axially surrounding said anode shell, said vanes defining cavities therebetween and said anode shell having a plurality of longitudinally extending slots coupling a plurality of said cavities with said main resonator, a magnetic pole piece extending axially inwardly from one end of said anode shell and having an end portion disposed in axially spaced relation from said vanes and with such end portion being dimensioned to provide a space between it and the surrounding portion of said anode shell, said slots extending into and terminating within surrounding portion of said anode shell, slot attenuator means within said space and overlapping the terminations of said slots for attenuating slot modes, and further means within said space for suppressing spurious resonances tending to cause anomalous power dissipation in said slot attenuator means.

2. A magnetron as claimed in claim 1 and wherein said further means is means for creating one or more short circuits between radially spaced points on said magnetic pole piece and said anode shell.

3. A magnetron as claimed in claim 1 and wherein said further means comprises short circuiting metallic pins extending between radially spaced points on said magnetic pole piece and said anode shell lying between adjacent slots in said anode shell.

4. A magnetron as claimed in 1 including a second magnetic pole piece extending axially inwardly from the opposite end of said anode shell and terminating in an end portion providing a space between it and the surounding portion of said anode shell, the opposite ends of said slots extending into said surrounding portion last mentioned, and wherein said further means is provided to create short circuits between radial points on both magnetic pole pieces and the anode shell.

5. A magnetron as claimed in claim 1 and wherein said further short means comprises metallic pins and wherein one pin is provided to extend between a point mid way between each pair of adjacent slots in the anode shell and a radially opposite point on said magnetic pole piece.

6. A magnetron as claimed in claim 1 and wherein the outer surface of said slot attenuator means is provided with a metallic skin in regions other than in strips, radially opposite the slots in said anode shell.

7. A magnetron as claimed in claim 6 and wherein the slot attenuator means is a lossy cylinder and said metallic skin is provided only on the internal cylindrical surface of said slot attenuator.

8. A magnetron as claimed in claim 6 and wherein said metallic skin is provided over the entire surface of said slot attenuator means except in regions radially opposite said slots in said anode shell.

9. A magentron as claimed in claim 6 and wherein said metallic skin is provided on said slot attenuator means by the evaporation of metal in vacuum, regions which are not required to be metallised having been protected by masking or shields.

10. A magnetron as claimed in claim 6 and wherein said metallic skin is provided on said slot attenuator means by forming said metallic skin from thin metal sheet which is pressed to shape.

11. A magnetron as claimed in claim 6 and wherein said metallic skin is provided on said slot attenuator means by metallic paint applied to the surface of said slot attenuator means.

12. A magnetron as claimed in claim 6 and wherein said metallic skin is provided on said slot attenuator means by sintering and electro plating the the surface of said slot attenuator.

13. A magnetron as claimed in claim 6 and wherein said metallic skin is provided on said slot attenuator by sputtering.

14. A co-axial multi-cavity anode magnetron as claimed in claim 1 and wherein a second magnetic pole piece extends axially inwardly from the other end of said anode shell, which second magnetic pole piece is also shaped to form a space between itself and said anode shell in the region of said slots and which last mentioned space also contains a slot attenuator and means operative to suppress spurious resonances tending to cause anomalous power dissipation in the slot attenuator provided in that last mentioned space.

15. A co-axial multi-cavity anode magnetron as claimed in claim 1 and wherein said axial slots extend through said anode shell in between alternate pairs of adjacent radial vanes.

16. In a co-axial multi-cavity magnetron of the type including inner wall means defining an anode shell, outer wall means co-axially surrounding said inner wall means and defining therewith a main resonator adapted to be excited in the circular electric TEO1 mode, a cathode co-axially surrounded by said anode shell, a plurality of vanes projecting radially inwardly from said anode shell toward but terminating short of said cathode to provide cavities between the vanes and an interaction space between the vanes and said cathode, means for producing a magnetic field in said interaction space, slot means for coupling said cavities to said main resonator whereby the latter is excited in said circular electric TEO1 mode, and slot mode attenuator means within the confines of said anode shell, the improvement which comprises:

short circuiting means, within said anode shell and connecting said means for producing a magnetic field to said anode shell, for suppressing spurious resonances within said anode shell causing anomalous power dissipation in said slot mode attenuator means.

* * * * *